United States Patent [19]

Bumber

[11] 4,002,835

[45] Jan. 11, 1977

[54] MULTI-CHANNEL DECODING CIRCUIT FOR TWO-CHANNEL AUDIO SYSTEMS

[76] Inventor: Roger L. Bumber, 740 S. Ridgeland Ave., Oak Park, Ill. 60304

[22] Filed: June 6, 1975

[21] Appl. No.: 584,589

[52] U.S. Cl. ..... 179/1 GQ; 179/1 G; 179/1 GP

[51] Int. Cl.[2] ..... H04R 5/00

[58] Field of Search ..... 179/1 GQ, 1 G, 1 GP, 179/100.4 ST

[56] References Cited

UNITED STATES PATENTS

| | | | |
|---|---|---|---|
| 3,219,757 | 11/1965 | Palladino | 179/1 GP |
| 3,632,886 | 1/1972 | Scheiber | 179/1 GQ |
| 3,697,692 | 10/1972 | Hafler | 179/1 GQ |
| 3,745,254 | 7/1973 | Ohta et al. | 179/1 GQ |
| 3,813,494 | 5/1974 | Bauer | 179/1 GQ |
| 3,818,136 | 6/1974 | Schott | 179/1 GQ |
| 3,835,255 | 9/1974 | Bauer | 179/1 GQ |
| 3,919,478 | 11/1975 | Schott | 179/1 GQ |

OTHER PUBLICATIONS

"The 'Stereo Plus' System" by Shottenfeld et al. in Audio, Oct. 1959, pp. 23, 114–116.

"Circuit for Three-channel Stereophonic Playback . . . " by Klipsch, Ire Transactions in Audio, Nov.–Dec. 1959, pp. 161–165.

*Primary Examiner*—Douglas W. Olms

*Attorney, Agent, or Firm*—McDougall, Hersh & Scott

[57] ABSTRACT

The decoding circuit of the present invention is a passive circuit which connects to the output terminals of a conventional stereophonic amplifier for decoding additional hidden channels of sound from a stereophonic or quadraphonic source. The circuit couples power from the two existing channels so as to provide additional output points at prescribed polarity and voltages to produce new and separate channels of sound. Capacitive reactance is utilized in the circuit to cause lagging voltages to produce a desirable phase shift while a variable impedance is provided to control the volume of the additional channel speakers relative to the existing speakers.

7 Claims, 10 Drawing Figures

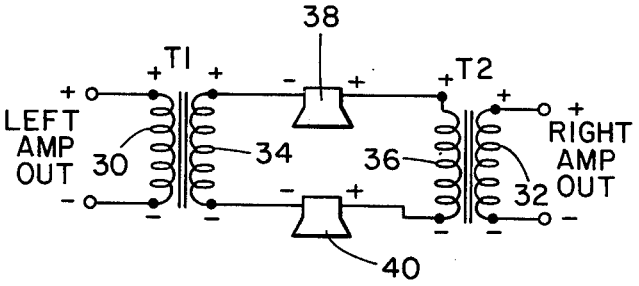
FIG.5
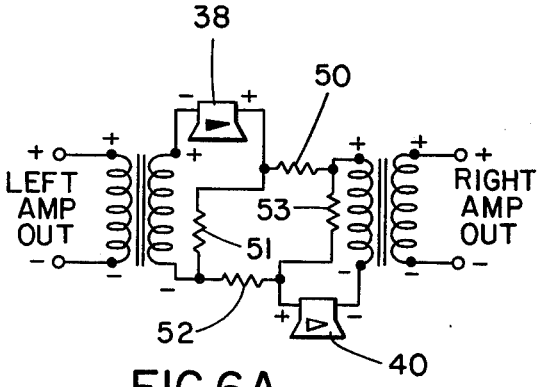
FIG.6A
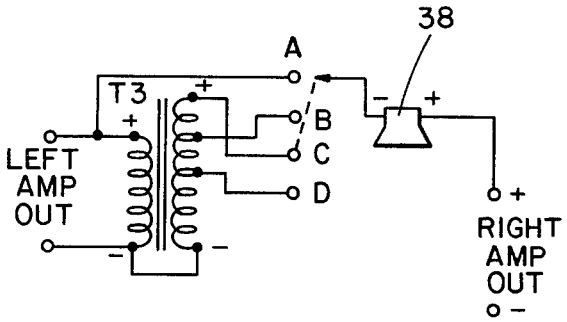
FIG.7
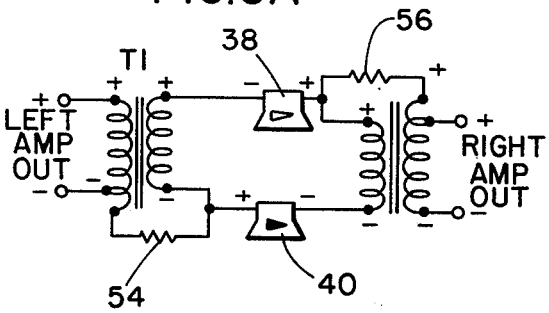
FIG.6B
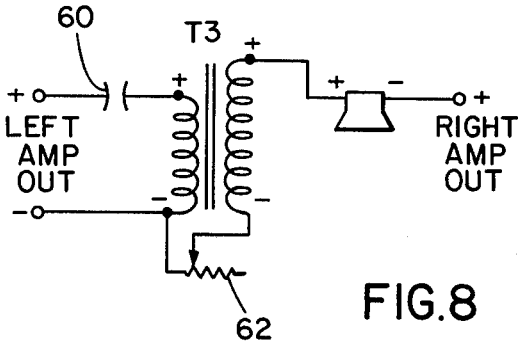
FIG.8
FIG.9
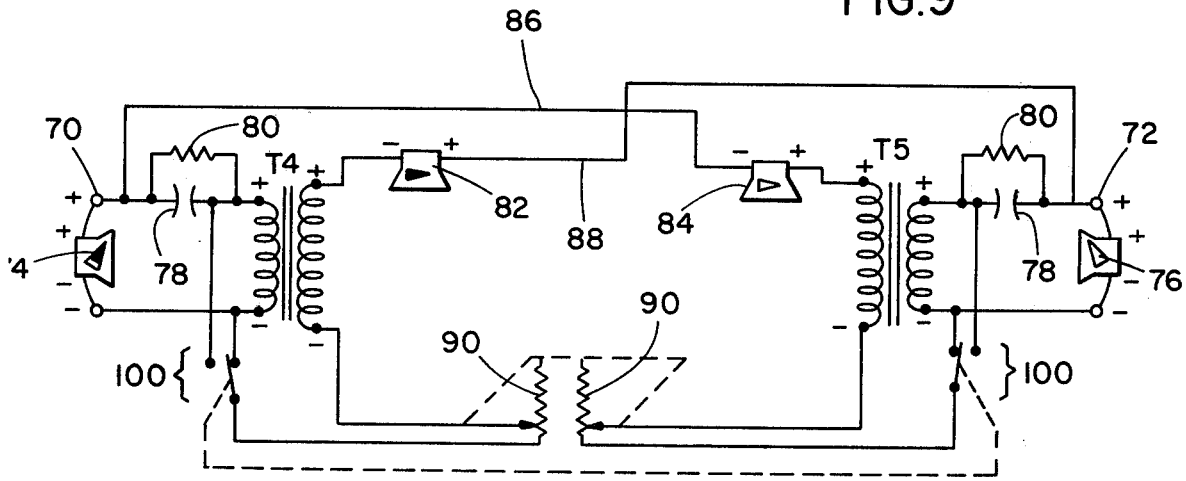

MULTI-CHANNEL DECODING CIRCUIT FOR TWO-CHANNEL AUDIO SYSTEMS

BACKGROUND OF THE INVENTION

The decoding circuit of the present invention relates to devices concerned with providing an audiophile with a more realistic and true-to-life rendition of a recorded performance. The concept of stereophonic high fidelity recording was the first step forward in trying to give a listener a more realistic feeling of being present at a live performance. This was done by providing two separate channels of sound played back through separate speakers. Recently there have been new developments in quadraphonic sound, some of which have included the use of four separate channels of sound while others have utilized synthetic additional channels. The purpose of the additional channels was to obtain the ambience of a performance by utilizing the background noise that would normally be present in an orchestra hall, for example. A drawback with such systems is that they require that the listener purchase new equipment capable of handling four channels of sound.

Conventional decoding circuits are of two basic types: active and passive. The active type decodes the sound at low levels, i.e., before amplification, necessitating duplicate additional amplifiers and the accompanying controls; thus the requirement for new equipment to replace existing stereophonic equipment where such active devices are utilized. In addition to requiring an expensive replacement to obtain the quadraphonic sound, the additional complexity adds to the probability of component malfunction. Previous passive type decoders which can be used with existing equipment simply couple two additional speakers in series across the speaker terminals of a stereo amplifier, occasionally utilizing a resistance to give some separation. Effectively this is an arithmetic addition. It takes no account of the phase relationship between the channels permitting the additional speakers unfavorably to interact with one another, producing fuzzy sound which is directionally ambiguous and fatiguing.

The present invention utilizes a simple passive design which takes advantage of natural acoustic principles to overcome the above deficiencies of previous passive decoding circuits.

It is accordingly an object of the present invention to provide a circuit for cross-coupling the signals of a conventional stereophonic amplifier to produce additional channels therefrom for driving additional loud speakers placed in a listening area.

It is another object of the present invention to produce a decoding circuit which can reproduce signal differences between the left and right channels of a stereo amplifier with selected polarity and phase relationship.

It is another object of the present invention to provide a decoding circuit which can be added to a stereophonic amplifier for providing four distinct channels of sound.

Other objects and advantages of the e invention will appear more fully in the concluding portion of this specification.

BRIEF DESCRIPTION OF THE DRAWINGS

FIG. 5 is a schematic circuit diagram of the invention according to a first embodiment;

FIGS. 6A and B are modifications of the basic circuit to obtain speaker separation from the FIG. 5 circuit;

FIG. 7 is a second embodiment of the circuit according to the present invention, also providing speaker separation;

FIG. 8 is a third embodiment of the invention employing a phase shift to accommodate tapes and records which have been recorded quadraphonically using "SQ" decoding points; and FIG. 9 is a fourth and preferred embodiment of the invention.

DETAILED DESCRIPTION

Figure 2:
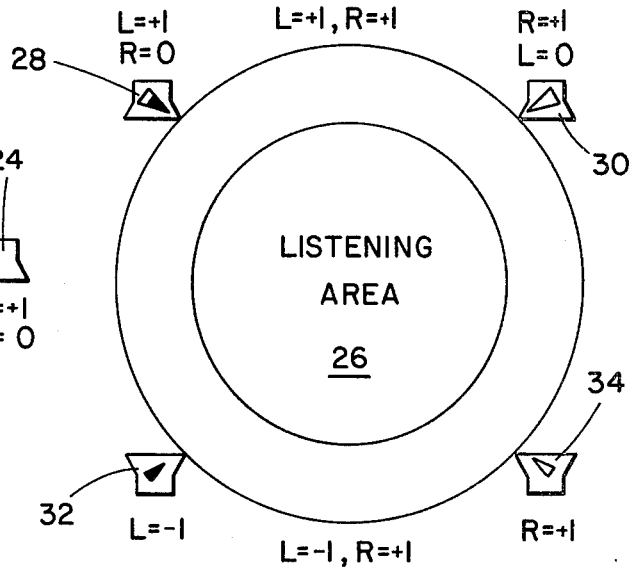
FIG. 2 illustrates the acoustic addition and redistribution of signals in a quadraphonic system, according to the present invention.

The decoding circuit of the present invention connects directly in parallel to the outputs (speaker terminals) of a stereophonic amplifier and provides two additional channels of sound to which two or more loud speakers may be connected. The speakers, the original two and the two or more added, are placed around a listening area, as illustrated in FIG. 2. Ideally, the two original speakers are placed at the left and right front (LF and RF) of the listening area and the two added speakers at the left and right rear (LR and RR). When stereophonic or quadraphonic music is played, the listener is surrounded by sound. The front speakers provide the usual stereophonic information while the rear speakers, as will be described, provide additional channels of sound adding an ambience or realistic element to the listening which is unequalled by present stereophonic equipment. The quality of music thus produced may be likened to that experienced at a live performance.

Figure 1:
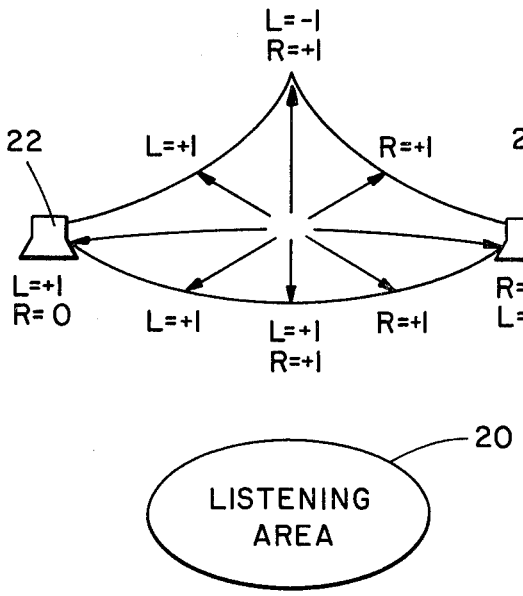
FIG. 1 illustrates the acoustic addition of signals between a pair of speakers in a stereophonic system.

Referring to FIG. 1, a listening area 20 is illustrated for a stereophonic system including a left speaker 22 and a right speaker 24. As indicated by the schematic diagram between the speakers, the elements of the music being reproduced move between the two speakers. When an equal phase condition exists, the sound appears to emanate from a point midway between the two speakers 22 and 24, producing a wall of sound. Out of phase information in a stereo system is generally either auditorium reverberation or audience noise and is attenuated by natural interaction.

Matrix four-channel systems of the type referred to in the background section of this specification move this out-of-phase information behind the listener to provide greater realism. This creates a surrounding of the listener by sound and reproduces the music all around the listener, permitting the movement of elements, i.e., instruments or vocalists, to any position in the listening area.

Figure 3:
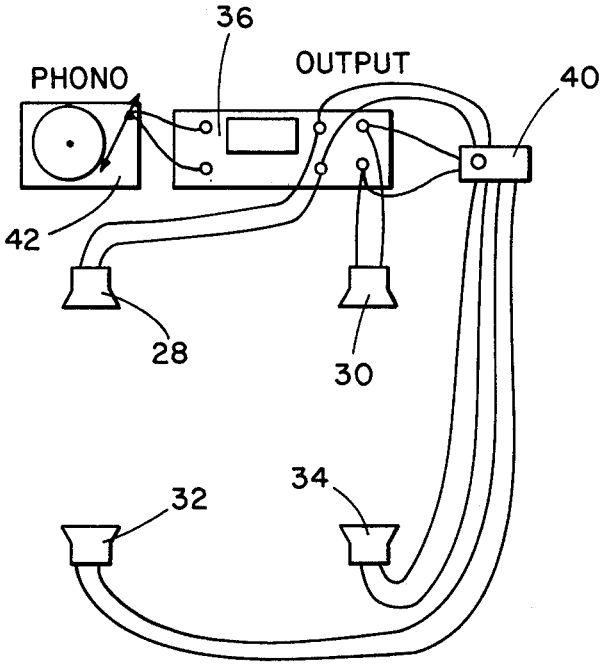
FIG. 3 illustrates schematically the manner of connecting the decoding circuit of the present invention to a stereo amplifier to produce a four-channel system.

In FIG. 2 the listening area 26 has LF and RF speakers 28 and 30 and LR and RR speakers 32, 34, respectively. FIG. 3 illustrates the manner in which the speakers 28–34 are hooked from a stereo amplifier 36, directly to the front speakers 28 and 30 in the conventional manner, and through the decoding circuit 40 of the present invention for the rear speakers 32, 34. In the usual manner, the amplifier 36 can select a signal source such as a phonograph 42 or an FM unit separate from or included with the amplifier 36.

Figure 4:
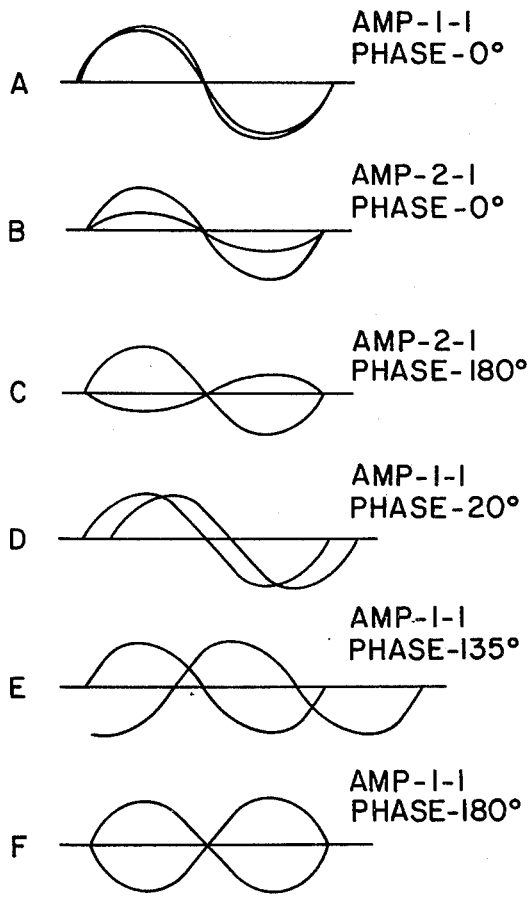
FIG. 4 is a set of wave forms which represent typical outputs from the left and right channels of a stereophonic amplifier and will be useful in discussing the operation of the circuit.

Referring to FIG. 4, various waveforms are illustrated in parts A–F illustrating a response that would be observed if both channels of a stereophonic system were coupled, for example, to a dual trace oscilloscope. In A, the left channel and right channel have equal amplitude and are in phase; thus, the signals overlap. In B, one channel has an amplitude of twice the other channel and are in phase. In C, one channel has twice the amplitude of the other and the channels are out of phase by 180°. In D, the channels are of equal amplitude but out of phase by a small angle of approximately 20°–25°. In E, the signals are of equal amplitude but phase-shifted 135°. In F, the signals are of equal amplitude but phase-shifted 180°.

Before discussing the decoding circuit, it will be useful briefly to discuss the principles of operation of the present invention. The decoding circuit employs a passive design which takes advantage of natural acoustic principles including (1) power distribution, (2) parallel speaker operation, and (3) mixing of signals in a speaker. By "power distribution" it is meant that dividing a given amount of power among a greater number of speakers will not lessen, save for small losses, the amount of power in the listening area. Thus, it will be apparent that existing stereo amplifiers can utilize the present invention without the need for additional power amplification. A further advantage is that all the controls of the stereo amplifier are master controls for the four-speaker system. The volume, bass, and treble controls affect the front and back speakers simultaneously while the balance control shifts the listening area from the left side of the listening area to the right side of both front and back pairs. The only additional control needed is a front-to-back balance control which is incorporated into the decoding circuit to be described.

Finally, the invention capitalizes on the ability of loudspeakers to mix signals in a particular manner. A speaker will produce audibly the difference between two signals applied to its terminals without mixing the portion of the signal that is not reproduced. Thus, a speaker reproduces the out-of-phase portion of signals applied to its terminals, thereby extracting out-of-phase information from the applied signals.

Referring to FIG. 4, the waveforms illustrated will serve to further clarify this important principle. In FIG. 4A, since both signals are in phase, the application of these signals to a speaker would result in no out-of-phase information being detected. This may be analogized to applying 5 volts A.C. (in phase) to both terminals of a light bulb whereby no current is caused to flow through the filament and therefore no light is produced. By contrast, in FIGS. 4C and 4F, the signals are seen to be out of phase by 180° and thus, if such signals are applied to the opposite terminals of the speaker, a significant amount of the signal information of one signal is out of phase with respect to the other signal. Returning to the light bulb analogy, it will be apparent that when the voltage on one bulb terminal is positive and on the other terminal negative, current will flow through the bulb causing it to light. In speakers, the result is, in an audio sense, very much the same. Thus, a speaker receiving the signals illustrated in FIGS. 4C and 4F will produce a difference signal extracted from the two signals connected to the speaker.

It will thus be apparent that the purpose of the invention is to cross-couple electrical power from the left and right speaker outputs of a stereophonic amplifier to additional speakers placed around a listening area. These speakers audibly reproduce a difference signal. The exact ratio, polarity and phase of the speaker is determined by the circuit parameters. In particular, the circuit parameters of the present invention are chosen to accommodate the existing quadraphonic systems now on the market often referred to as "SQ" and "QS" systems.

Referring now to FIG. 5, the basic circuit of the present invention is illustrated. The circuit includes transformers T1 and T2 having primaries 30, 32 and secondaries 34, 36, respectively. Connected to the secondaries of the transformers are speakers 38, 40. As indicated, speakers 38, 40 are connected in parallel between the secondaries 34, 36 of the transformers, with the terminal polarities as indicated. The primaries of transformers T1 and T2 are connected to the output terminals of a stereophonic amplifier. Speakers 38, 40 represent the left and right rear speakers illustrated in FIG. 2, which speakers will audibly reproduce the out-of-phase information from the left and right channels of the stereophonic amplifier. As can be understood by considering the circuit in conjunction with FIG. 4, information from the left and right channels which is in phase is cancelled in these rear speakers and only the out-of-phase information is audibly reproduced. Thus the signals illustrated in FIGS. 4C, 4D, and 4F would be audible from the speakers 38, 40 while no output would be produced by signals from the left and right amplifiers which have the waveforms indicated by FIGS. 4A and 4B, since they are exactly in phase.

The FIG. 5 circuit is not entirely satisfactory in that both speakers 38, 40 will reproduce the same information which is equivalent to a center back output. In order to obtain better sound, it is desirable to separate the rear channels so that speaker 38 produces information, for example, more closely associated with the left amplifier channel than speaker 40, and vice versa.

Referring to FIGS. 6A and 6B, a modification of the FIG. 5 circuit is illustrated wherein a resistor network, including resistors 50–53, are inserted in the basic circuit to obtain back separation between the speakers 38 and 40. Thus, speaker 38 will reproduce signals from the left amplifier channel more strongly while speaker 40 will reproduce more of the right amplifier channel.

FIG. 6B employs resistors 54, 56 to connect the primaries of the transformers to the positive terminals of the speakers 38, 40. This couples some of the in-phase information from the primary circuit and similarly tends to produce separation of the back speakers 38, 40. Although these modifications to the basic circuit effect a separation of the back speakers, it is considered inefficient, since better alternatives are available.

Referring now to FIG. 7, a second embodiment of the invention is illustrated. For simplicity, FIG. 7 illustrates one-half of the circuit with the remaining half being identical but for the right amplifier channel. In FIG. 7, the output from the left amplifier is provided to a transformer T3 having a secondary with a plurality of taps. By means of a selectable switch, the negative input of the left speaker 38 can be connected to the various points A, B, C, or D on the secondary of transformer T3. This circuit illustrates the principle of obtaining back separation between speakers 38 and 40 by varying the primary to secondary ratio of the transformer T3. The use of a step-up transformer has been found to be more efficient than the resistor network circuits illustrated in FIG. 6.

With the switch in position A, the speaker will produce an output identical to that illustrated for the circuit in FIG. 5, i.e., center back. A similar result is obtained at point B where a ratio between the primary and secondary is 1 to 1. That is, since the transformer ratio is a 1-to-1 match it also produces center back information.

At point C, the transformer has the indicated impedance ratio of 1 to 2, i.e., it is a step-up transformer. A balanced mix or left and right channel information giving even separation between the left back and right back is obtained. Further, side separation, i.e., left side and right side between the speaker pairs, is also satisfactory. Ratios which are higher than those indicated in FIG. 7 produce a reduction in side separation.

A lower ratio approaching 1 to 1 causes less back separation. For example, at point D, a 2-to-1 step-down ratio is produced; thus, the speaker 38 obtains more right-channel information than left-channel information, and thus a reversal of the speaker information is produced.

A limitation of the FIG. 7 circuit is that it compensates for amplitude differences, for example, as indicated in FIGS. 4B and 4C but does not account for leading and lagging signals, i.e., phase shifts, for example, as illustrated in FIGS. 4C and 4D.

Referring now to FIG. 8, a modification of the FIG. 7 circuit is illustrated wherein a capacitor 60 is added to the primary side of the transformer between the positive output from the amplifier and the primary. Adding capacitor 60 produces a 90° lag because of the capacitive interaction with the inductive load of the speaker throughout most of the audio range, i.e., 200 Hz to about 1200 Hz. In practice, the capacitor should be sized at about 50 mfd. The FIG. 8 circuit is also provided with a variable resistance 62 between the primary and secondary of the transformer T3. Resistance 62 is utilized to absorb a portion of the power provided to the rear speakers without affecting the phase or amplitude. It should be noted that in FIG. 8 the transformer T3 has been connected so that a 1 to 2 step-up ratio is utilized to provide the desirable back separation discussed in connection with FIG. 7. The addition of capacitor 60 and variable resistance 62 results in desirable back separation being maintained while phase shift and power control are accounted for. The FIG. 8 circuit employs capacitor 60 primarily to accommodate quadraphonically recorded material. Quadraphonic decoding points utilized by the industry are most satisfactorily decoded by producing this resultant phase shift.

Referring now to FIG. 9, a final and preferred embodiment of the invention is illustrated. FIG. 9 incorporates the advantages of FIGS. 7 and 8 therein and produces a further refinement on the circuit to provide a most satisfactory decoding circuit. In FIG. 9, the outputs from the stereophonic amplifier are identified by terminals 70, 72. The left front speaker 74 is connected acros the terminal 70 to the minus of the amplifier, while speaker 76 is similarly connected across terminal 72. Also connected to the outputs from the amplifier are transformers T4 and T5, both of which are step-up transformers preferably having the ratio 2.5 to 1, i.e., 8 ohms to 20 ohms. Transformers T4 and T5 are connected to the amplifier output terminals 70 and 72 via capacitors 78 and swamping resistor 80.

Connected to the secondaries of transformers T4 and T5 are the rear speakers: 82 for the left rear and 84 for the right rear. Lines 86, 88 connect one terminal of back speaker directly to the amplifier outputs, while one side of the secondaries of transformers T4 and T5 are each connected through a ganged variable resistance 90 to the minus of the primary circuit, the other side of the secondary being connected to the speakers 82 and 84.

Comparing FIG. 9 with the circuit described in FIG. 8, it will be apparent that resistors 80 have been added in shunt with the capacitor 78. Swamping the capacitor in this manner makes the phase shift that the circuit produces approximately 45° rather than 90°, and is a better compromise between the SQ decoding points for quadraphonic material and stereo material. It will be noted that transformers T4 and T5 use a slightly higher step-up ratio than utilized in FIGS. 7 and 8 to compensate for the insertion losses which are greater in the FIG. 9 circuit. It will be appreciated that since step-up transformers are utilized, the rear speakers 82, 84 are relatively louder than the front speakers, so a back volume control is necessary. Such volume control is provided by variable resistors 90 so that the volume of the back speakers relative to the front speakers can be balanced.

Referring to the switching arrangement 100 which alternatively connects the negative side of the primary of transformers T4 and T5 to the ganged variable resistors 90, it will be appreciated that this is an optional switching arrangement. Switching arrangement 100 in the position illustrated connects the negative side of the transformers T4 and T5, while in the alternate position, connects the positive side of the primary of these transformers to the ganged resistors 90. This switching arrangement is not essential to the invention but provides a desirable means for shifting the output of the sound system. In the position illustrated in the figure, the circuit exhibits best separation for a QS quadraphonic source while providing a concert hall effect for an SQ quadraphonic source. In the alternate position, greater separation is obtained for SQ material while a concert hall effect is obtained for QS material.

Physically, movement of the switching arrangement 100 to the alternate position effects a coupling of the plus side of the primary to the minus side of the secondary of each of the transformers. It should be noted that for purposes of understanding the present invention, the circuit can be considered without the switching arrangement 100 with the ganged resistors 90 connected only to the negative side of the primaries.

As will be appreciated from the principles given thus far in the specification, the FIG. 9 circuit is effective for applying the stereophonic signal from the outputs of a stereo amplifier through a step-up transformer to a pair of rear speakers, each of which will reproduce the out-of-phase information from the two channels. As will further be appreciated, each speaker is biased toward the opposite one of the two channels so that back out-of-phase information is additive. The purpose of the resistors 80 and the capacitor 78, as has been stated, relates to the necessity for accommodating quadraphonically prepared material which is often coded in the SQ format.

While I have shown and described embodiments of this invention in some detail, it will be understood that the description and illustrations are offered merely by way of example, and that the invention is to be limited in scope only by the appended claims.

I claim:

1. A passive bridging circuit for producing additional powered channels of audio information from the speaker outputs of the left and right channels of a stereo amplifier comprising:

a. a pair of loudspeakers each having a positive and negative terminal for connecting to an audio source;

b. left and right channel transformers having primaries and secondaries, the primaries being connected to the said stereo amplifiers's left and right speaker position and negative outputs respectively, the loudspeakers coupling the secondaries of the two transformers, one loudspeaker between the two plus terminals of the secondaries and the other loudspeaker between the two minus terminals, and c. resistive means connecting the primaries of said transformers to one of said speaker terminals for coupling in-phase information to said speakers to obtain back separation, whereby said loudspeakers are coupled across the left and right channels of said amplifier to reproduce sound corresponding to the difference between the left and right signals from the amplifier.

2. A passive bridging circuit producing two additional powered channels of audio information from the speaker outputs of the left and right channels of a stereo amplifier comprising:

a. left and right channel speakers having positive and negative terminals for connection to an audio source; and b. left and right channel transformers each having primary and secondary windings, the left transformer primary being connected across said left channel output, the right transformer primary being connected across said right channel output, the positive side of the left transformer secondary being connected to one terminal of said left speaker, the positive side of the right transformer secondary being connected to one terminal of the right speaker, the remaining speaker terminals being connected to the positive terminal of the opposite channel output, the negative side of the transformer secondaries being connected to one side of its own primary winding whereby the primary to secondary ratio determines the ratio of the mixture from each channel produced by said speakers and the phase of the secondary voltage determines the phase of the signals produced by said speakers.

3. A circuit according to claim 2 wherein the positive side of the transformer primaries are connected to the amplifier channels through a capacitive impedance to produce a phase shift over a substantial portion of the audio frequency range whereby desirable back separation and phase compensation is obtained for quadraphonically recorded materials.

4. A circuit according to claim 3 wherein a variable impedance is added to the circuit to control the total power available to said speakers.

5. A circuit according to claim 4 further including ganged switching means for connecting the negative side of both transformer secondaries to either the positive or negative sides of their corresponding transformer primaries.

6. The circuit according to claim 3 wherein said capacitive impedance includes a capacitor having a swamping resistor connected thereacross.

7. A circuit according to claim 2 wherein said transformers having a primary to secondary step-up ratio, said secondaries being in-phase with the primaries, whereby each loudspeaker responds more strongly to the out of phase signals from the amplifier channel coupled through the transformers than to the direct coupled channel.

* * * * *